US005596863A

United States Patent [19]

Kasel

[11] Patent Number: 5,596,863

[45] Date of Patent: Jan. 28, 1997

[54] METHOD AND APPARATUS FOR APPLYING EDGE PROTECTORS

[75] Inventor: Calvin E. Kasel, Wauconda, Ill.

[73] Assignee: Illinois Tool Works Inc., Glenview, Ill.

[21] Appl. No.: 489,452

[22] Filed: Jun. 12, 1995

[51] Int. Cl.[6] ..... B65B 61/22

[52] U.S. Cl. ..... 53/399; 53/410; 53/139.7; 53/589; 414/789.5; 414/927

[58] Field of Search ..... 414/789.5, 927, 414/795.2; 53/139.6, 139.7, 410, 589, 399, 155, 156, 541

[56] References Cited

U.S. PATENT DOCUMENTS

| | | | |
|---|---|---|---|
| 3,271,925 | 9/1966 | Aubery | 53/139.6 |
| 4,764,074 | 8/1988 | Postigo | 414/795.2 |
| 5,216,871 | 6/1993 | Hannen | 53/399 X |
| 5,226,280 | 7/1993 | Scherer et al. . | |
| 5,289,668 | 1/1994 | Meyer . | |

OTHER PUBLICATIONS

"Control Your Packaging Costs With the CLM8 Compression Strapping System", 1994, Signode Container Industry Systems, TC/TC/BD, SPD 1255, Rev. Aug. 1994.

CH/PRS 2600, Castaldini S.p.A., HiTek Equipment, Inc., Board Converting News, Jun. 20, 1994.

CH/MTZ, CH/TG/TJ, CH/TG/MTZ, Castaldini S.p.A.

*Primary Examiner*—Linda Johnson

*Attorney, Agent, or Firm*—Schwartz & Weinrieb

[57] ABSTRACT

A strapping system in which edge protectors are disposed between a load and tensioned strapping applied about the load in a strapping station. Edge protector applicator assemblies located on opposite sides of the load position edge protectors adjacent top and bottom surface edge portions of the load when the load is raised above a deck. The edge protectors are folded over and retained on edges of the load upon application of the tensioned strapping about the load to protect the edges of the load from the tensioned strapping. The strapping system includes a movable frame with spaced support members disposed below the deck and aligned with spaces in the deck. The frame is raised and lowered so that the support members of the frame extend through the spaces of the deck to lift the load above the deck to allow positioning of the lower edge protectors adjacent to the load. The frame is guided as it is raised and lowered by rotatable shafts aligned substantially parallel with corresponding side portions of the frame. Each shaft includes a miter gear disposed on its end portions for engagement with a miter gear of an adjacent shaft to permit synchronized rotation of the shafts. A pinion gear rotatable with the shaft and engagable with a rack on an adjacent side portion of the frame guide the frame as it is raised and lowered.

16 Claims, 8 Drawing Sheets

METHOD AND APPARATUS FOR APPLYING EDGE PROTECTORS

FIELD OF THE INVENTION

The invention generally relates to strapping systems for applying a tensioned strapping to a load, and more particularly to a method and apparatus for a strapping system with an edge protector applicator assembly for positioning an edge protector adjacent edges of the load prior to application of the strapping, wherein the edge protector is retained between the edges of the load and strapping to protect the edges of the load from the tensioned strapping.

BACKGROUND OF THE INVENTION

Packaged articles are frequently secured by tensioned strapping or stretched film applied about the article, or load, by a strapping or film applicator. To prevent the tensioned strapping or film from damaging edges of the load, an edge protecting device is positioned along the edges of the load prior to the application of the strapping or film, wherein the edge protecting device is retained between the edges of the load by the tensioned strapping or film. Existing edge protecting devices include preformed corner protectors comprised of right-angled strips made from plastic, cardboard or laminated paper having a length that extends along the entire expanse of the edge of the load. These right-angled edge protecting the devices are particularly suitable for protecting vertical corners of palletized loads secured by tensioned film, and may be positioned along the corners of the load prior to the application of the strapping in an automated operation. Packaged articles secured by steel or polymer strapping however do not require an edge protector that extends along the entire edge of the load since the strap is applied to only a portion of the load. To reduce costs and improve efficiency, it has been suggested to apply an edge protector, or pad, along only those edge portions of the load over which the strapping is applied. These reduced-size edge protectors are also preformed right-angle pads made from a plastic, cardboard or a folded laminated paper. Right-angle edge protectors have the disadvantage that they must be accurately positioned along the edge of the load. Improper positioning of the edge protectors causes improperly applied strapping, breakage of the edge protector upon application of the strapping, and uneven tension applied to the load. Further adverse results include unsecured application of strapping about the load, unprotected or inadequately protected edges, wasted material, and delays which decrease productivity. Reduced-sized edge protectors have the further disadvantage that they require precise positioning in relation to the location of the applied strapping. In this case improper positioning of the pad under the strap will not provide a proper distribution of the forces over the edge of the load again resulting in potential damage to the load. Accurate positioning of preformed pads is further complicated by the right-angle shape of the pads which, in automated processes, requires a complex apparatus for storing, dispensing, and accurately positioning the preformed pads prior to application of the strapping. Preformed edge protectors have other disadvantages. Plastic edge protectors are often formed by an extrusion process, and preformed cardboard edge protectors are formed by a molding process both of which are time consuming and expensive. Furthermore, preformed plastic and cardboard edge protectors are somewhat rigid which is not suitable for all applications. In particular, soft loads like stacks of corrugated cardboard may be damaged by overly rigid edge protectors, the ends of which may cut into the edges of the load. To overcome this problem it has been suggested to apply several stacked and folded cardboard edge protectors to each edge of the load. Folded laminated cardboard edge protectors are less expensive, but have a tendency to separate and unfold prior to application which gives rise to significant problems in the automated dispensing and positioning of the stacked edge protectors. Furthermore, folded cardboard edge protectors do not distribute the binding forces of the strapping very well and may still result in damage to the edges of the load. In applications where the strapping is applied about horizontal edges of the load, it is necessary to provide a space between the load and the surface or deck on which the load is positioned to allow application of the strapping about the bottom surface of the load. To overcome this problem, in the past, the deck of the strapping station has been lowered in relation to the load which is supported by stationary members which extend through the lowered deck. Lowering of the deck however is complicated and requires that the deck initially be elevated above ground level. An elevated deck further requires that the load transporting conveyors which deliver and remove loads to and from the deck likewise be elevated.

In view of the discussion above, there exists a demonstrated need for an advancement in the art of edge protectors and a method and apparatus of applying edge protector to a load in an automated strapping system.

OBJECTS OF THE INVENTION

It is therefore an object of the present invention to provide a novel method and apparatus for a strapping system with an edge protector applicator assembly for positioning an edge protector adjacent the edges of the load prior to the application of the strapping, wherein the edge protector is retained between the edges of the load and the strapping so as to protect the edges of the load from the tensioned strapping.

It is another object of the present invention to provide a novel method and apparatus for positioning an improved edge protector adjacent a load in an automated strapping station that is economical.

It is a further object of the present invention to provide a novel method and apparatus for positioning an edge protector adjacent a load in an automated strapping station that includes a means for lifting the load above a deck of the strapping station for insertion of the edge protector adjacent the load.

It is a more general object of the present invention to provide a novel method and apparatus for dispensing an article from a magazine and for positioning the dispensed article adjacent a target.

It is a further general object of the present invention to provide a novel method and apparatus for raising and lowering a load.

SUMMARY OF THE INVENTION

Accordingly, the present invention is directed toward a novel method and apparatus for a strapping system in which edge protectors are disposed between a load and tensioned strapping applied about the load in a strapping station having a deck. The system includes a means for raising the load above the deck and lowering the load back down onto the deck. Edge protector applicator assemblies located on opposite sides of the load position edge protectors adjacent top and bottom surface edge portions of the load when the load is raised above the deck. The edge protectors are folded over and retained on the edges of the load upon application of the tensioned strapping about the load to protect the edges of the load from the tensioned strapping. Each edge protector applicator assembly includes an ejector assembly for ejecting an edge protector from an edge protector magazine, and a gripper assembly movable back and forth along a track, wherein the gripper assembly is capable of gripping the edge protector ejected from the ejector assembly and then moving the same toward the load to position the edge protector adjacent the load. The strapping system also includes a frame with spaced support members disposed below the deck, wherein the spaced support members are aligned with spaces in the deck. The frame is raised and lowered, wherein the support members of the frame extend through the spaces of the deck so as to lift the load above the deck when the frame is raised to allow positioning of the lower edge protectors adjacent to the load. A means for guiding the frame as it is being raised and lowered includes a rotatable shaft aligned substantially parallel with corresponding side portions of the frame, and each shaft includes a miter gear disposed on its end portions for engagement with a miter gear of an adjacent shaft to permit synchronized rotation of the shafts. Each shaft also includes a pinion gear rotatable with the shaft and engagable with a rack on an adjacent side portion of the frame so as to guide the frame as it is being raised and lowered.

BRIEF DESCRIPTION OF THE DRAWINGS

These and other objects, features and advantages of the present invention will become apparent upon consideration of the following Detailed Description of the Invention with the accompanying drawings in which like reference characters designate like or corresponding parts throughout the several views, and wherein.

DETAILED DESCRIPTION OF THE INVENTION

Figure 1:
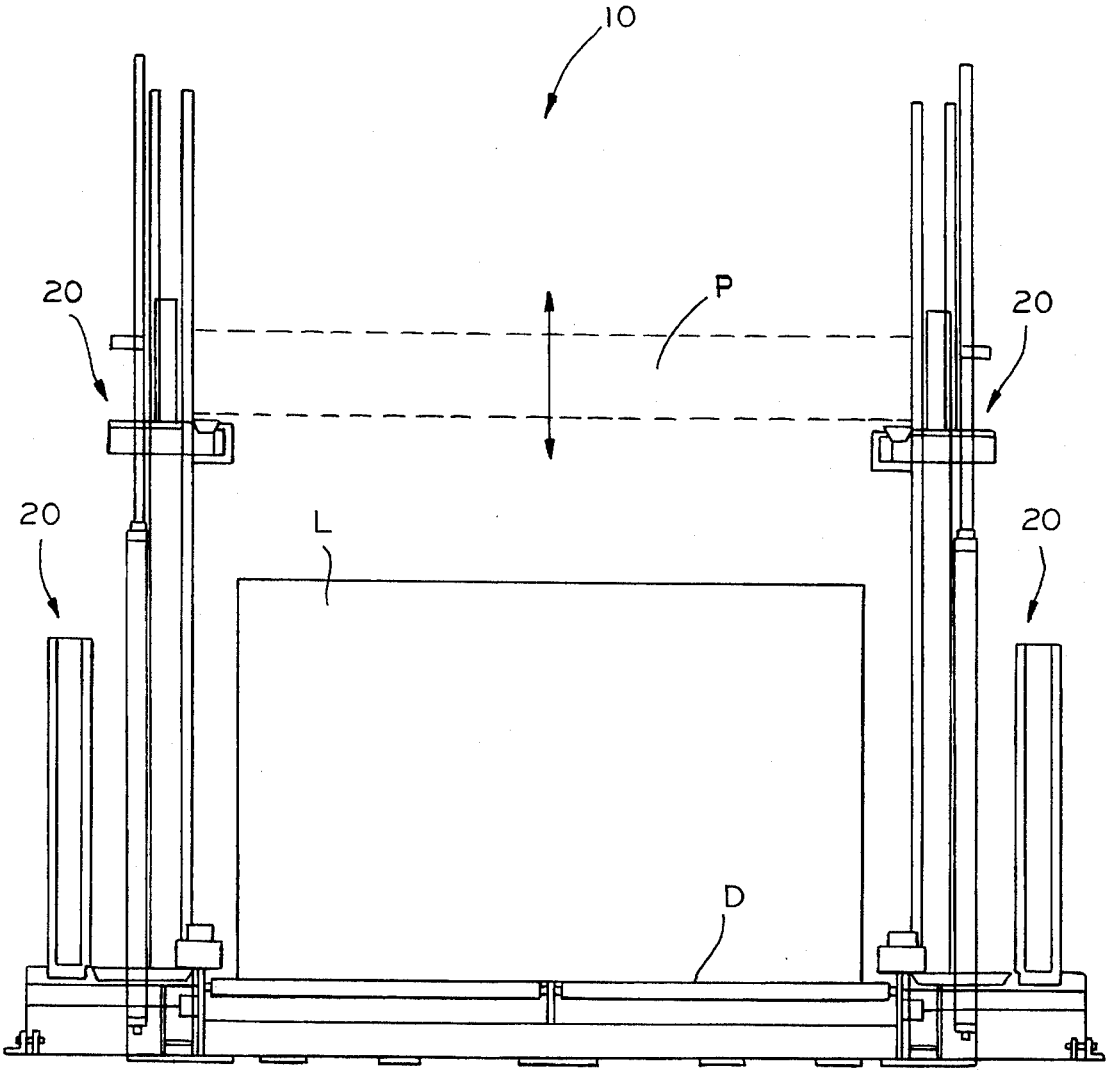
FIG. 1 is a partial side view of a strapping system for applying tensioned strapping to a load, the system including sheet edge protector applicator assemblies for positioning an edge protecting sheet adjacent the edges of the load.
Figure 6:
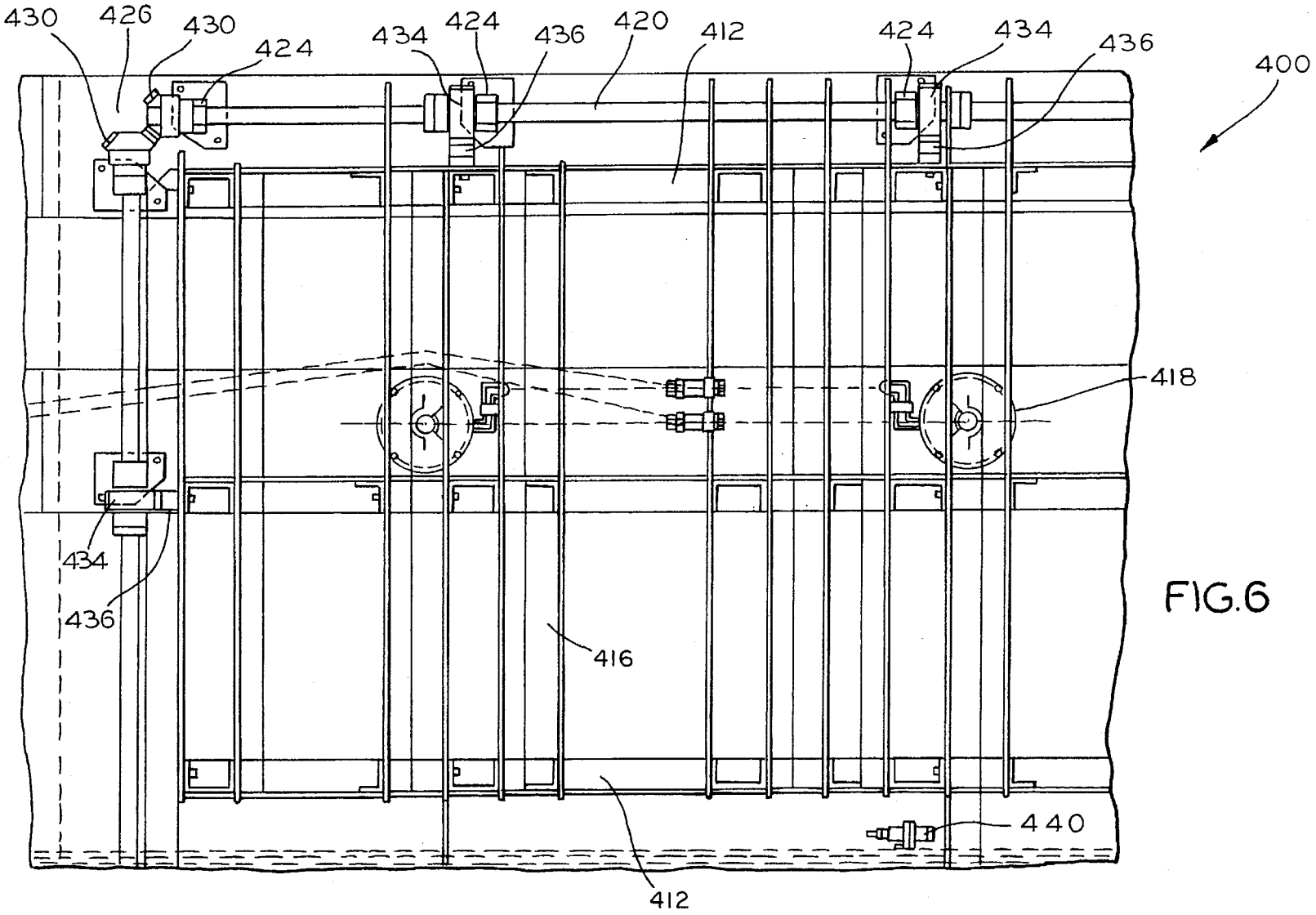
FIG. 6 is a partial top view of a load lift assembly which is disposed below the deck D of the strapping system of FIG. 1 for lifting the load above the deck D to permit Sepa assemblies to position pads adjacent the lower edges of the load.
Figure 7:
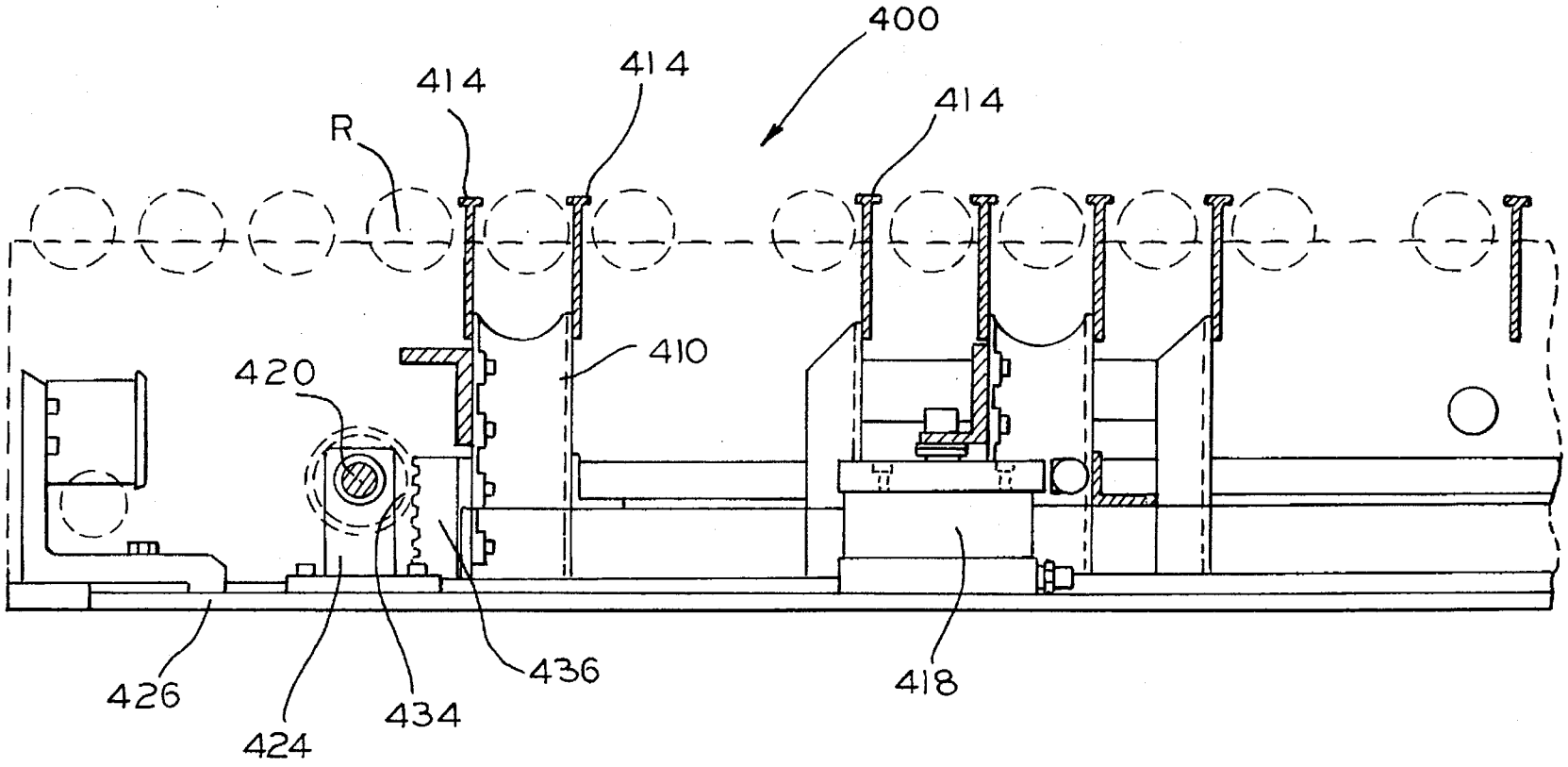
FIG. 7 is a partial sectional end view of the load lift assembly disposed below the deck of the strapping station.

FIG. 1 is a partial side view of a strapping system generally comprising a strapping station 10 with a deck D about which is disposed one or more strapping applicators not shown in the drawing, but known in the art, for applying strapping to a load L situated on the strapping deck D. A movable hydraulic platen P moves up and down for compressing the load prior to application of the strapping as is known in the art. The strapping assembly of the present invention includes upper and lower sheet edge protector applicators (Sepas) 20 on each side of the strapping station for positioning an edge protector adjacent top and bottom edge portions of the load. Generally, four Sepa assemblies correspond to each strapping applicator. The lower Sepa assemblies are mounted proximate the deck, and insert the pad adjacent a bottom surface edge portion of the load. The upper Sepas are mounted on the movable platen, and insert the pad adjacent a top surface edge portion of the load. FIG. 6 is a partial top view of a load lift assembly disposed below the deck D for lifting the load above the deck D so as to permit insertion of the lower pads between the load and deck prior to application of the strapping, and the movable platen P permits insertion of the upper pads between the load and the platen prior to application of the strapping as further discussed below. In one embodiment, the deck D is comprised of a series of spaced rollers R, as seen in FIG. 7 and is serviced by an assembly line conveyor, not shown in the drawing, which permits ready positioning of the load onto the deck for strapping and later removal of the strapped load from the deck. The edge protectors are folded over the edges of the load and retained between the strapping and the edges of the load upon application of the strapping, wherein the edge protectors protect the edges of the load from the tensioned strapping.

Figure 2:
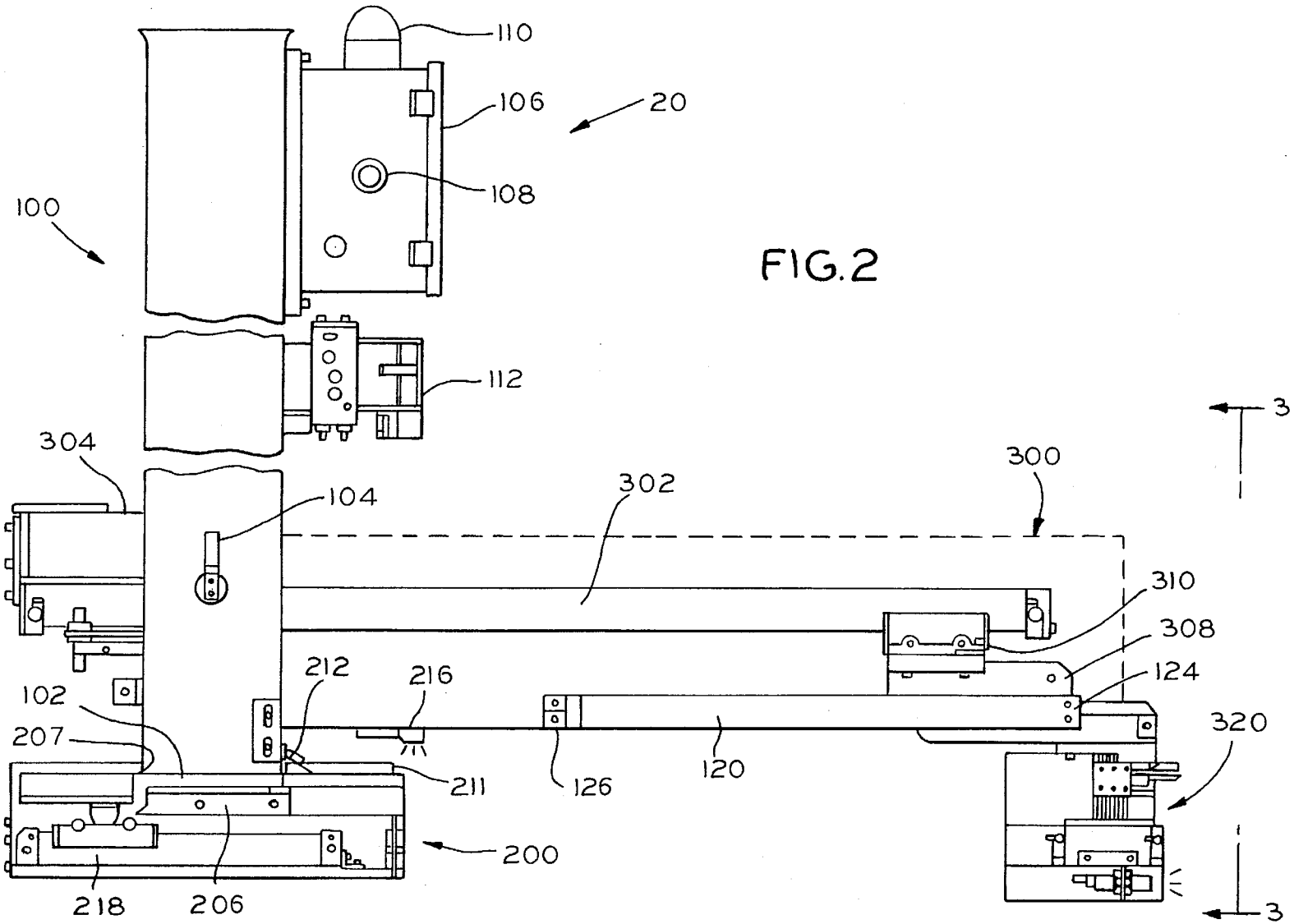
FIG. 2 is a partial side view of a sheet edge protector applicator (Sepa) assembly configured for positioning a sheet edge protector adjacent an edge of the load, which illustrates a partial sectional view of a sheet ejector assembly of the Sepa.

FIG. 2 is a partial side view of a Sepa assembly 20 configured for positioning an edge protector adjacent an upper edge of the load. The Sepa generally comprises a magazine 100 for receiving a stacked quantity of edge protectors, an ejector assembly 200 for ejecting individual edge protectors from the magazine, and a gripper assembly 300 for gripping an ejected edge protector and positioning the edge protector adjacent an edge of the load prior to application of the tensioned strapping. The edge protector is formed of a substantially flat but pliable material that is foldable over and around the edges of the load during application of the strapping so as to distribute the binding forces of the strap over an enlarged surface area of the load edge which prevents the load from being crushed or otherwise deformed under the tension of the strapping. The edges of the load are best protected by an edge protector formed of a material that is both pliable and somewhat compressible when subjected to deformation forces of the tensioned strapping. In one embodiment, the edge protectors comprise a laminated cardboard sheet having an inner corrugated cardboard portion and flat cardboard portions laminated to outer surface portions of the corrugated portion. In the exemplary embodiment, the edge protector has substantially rectangular dimensions of approximately eight by six by one eighth inches. The edge protector, or pad, may be positioned along the edge of the load so that the corrugations are aligned with the edge to facilitate folding of the pad. In other embodiments, the pad is scored or grooved, wherein the scored portion facilitates folding of the pad over the edge of the load. Those skilled in the art will appreciate that other articles having similar properties and other shapes and dimensions are also suitable for use with the Sepa to protect the edges of the load.

Figure 3:
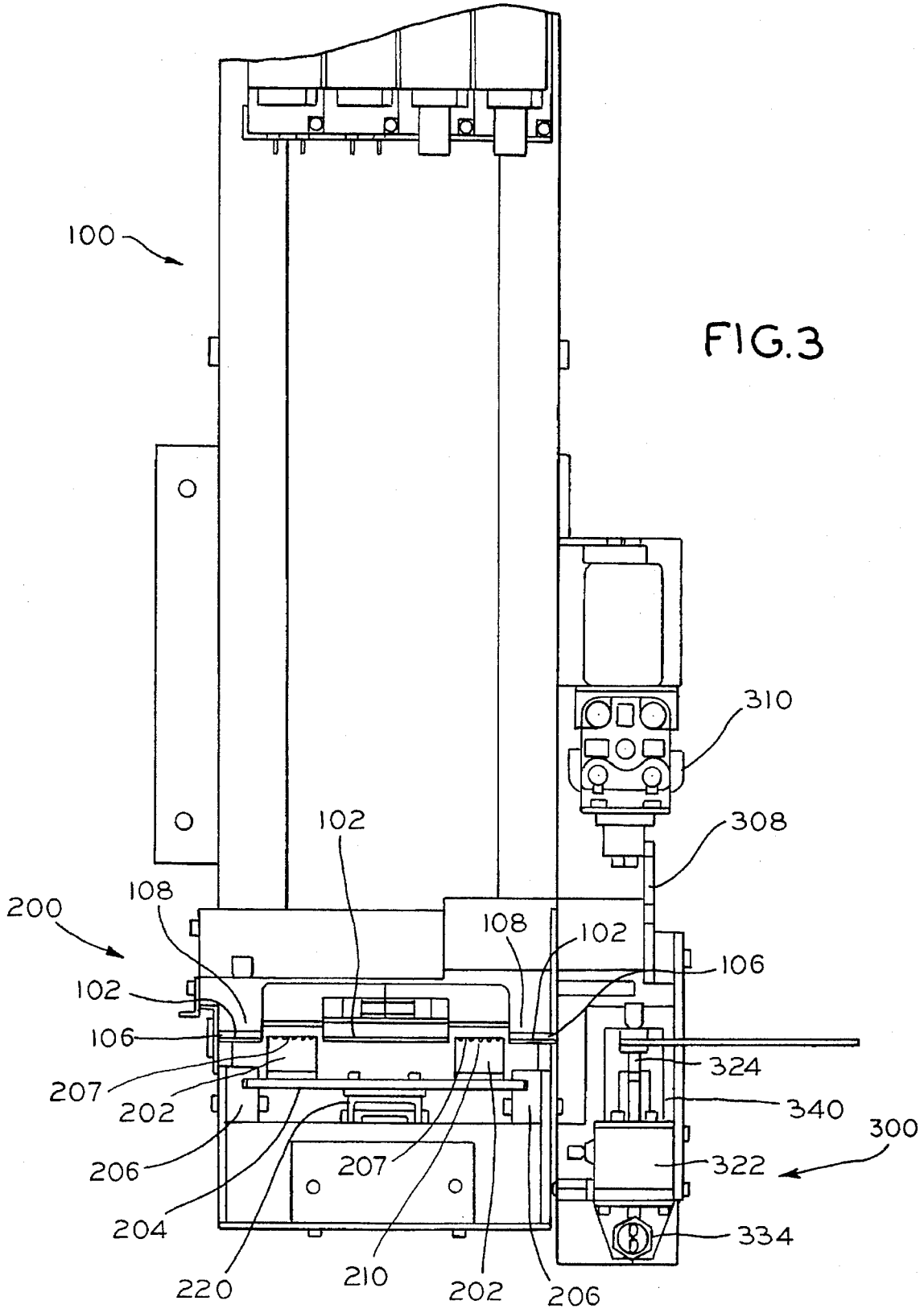
FIG. 3 is a partial end view of a Sepa along lines 3—3 of FIG. 2.

FIGS. 2 and 3 illustrate side and end views, respectively, of the magazine 100 with a cross-sectional shape which will accommodate a supply of edge protectors, or pads, arranged in a stack, which sectional shape in the exemplary embodiment is rectangular. A lower portion of the magazine includes inwardly directed lateral flanges with support surfaces 102 for supporting the stack of pads in the magazine, wherein the support surfaces 102 contact side portions of a lowermost pad. In the exemplary embodiment, there is a third flange with a supporting surface 102, intermediate the lateral flanges, for supporting an intermediate portion of the lowermost pad. In one embodiment, the magazine is in a vertical orientation and the stacked pads are biased against the support surfaces 102 by gravity, but the pads may also be subject to spring force applied from a closable cover on top of the magazine to ensure proper feeding and possibly permit non-vertical orientation of the magazine. FIG. 2 illustrates a sensor 104 mounted on the outer portion of the magazine and directed into the magazine through a suitably located port for monitoring the supply of stacked pads in the magazine. The sensor may be used to actuate an audio or visual signal to indicate when the pad stack has been depleted to a level below the level of the sensor port. In one embodiment, the sensor is a photoelectric diffuse reflective sensor which detects the presence or absence of pads in the magazine. For example, a Cutler-Hammer Comet 100 Series Perfect Prox™ proximity sensor may be used as the sensor 104.

Figure 5:
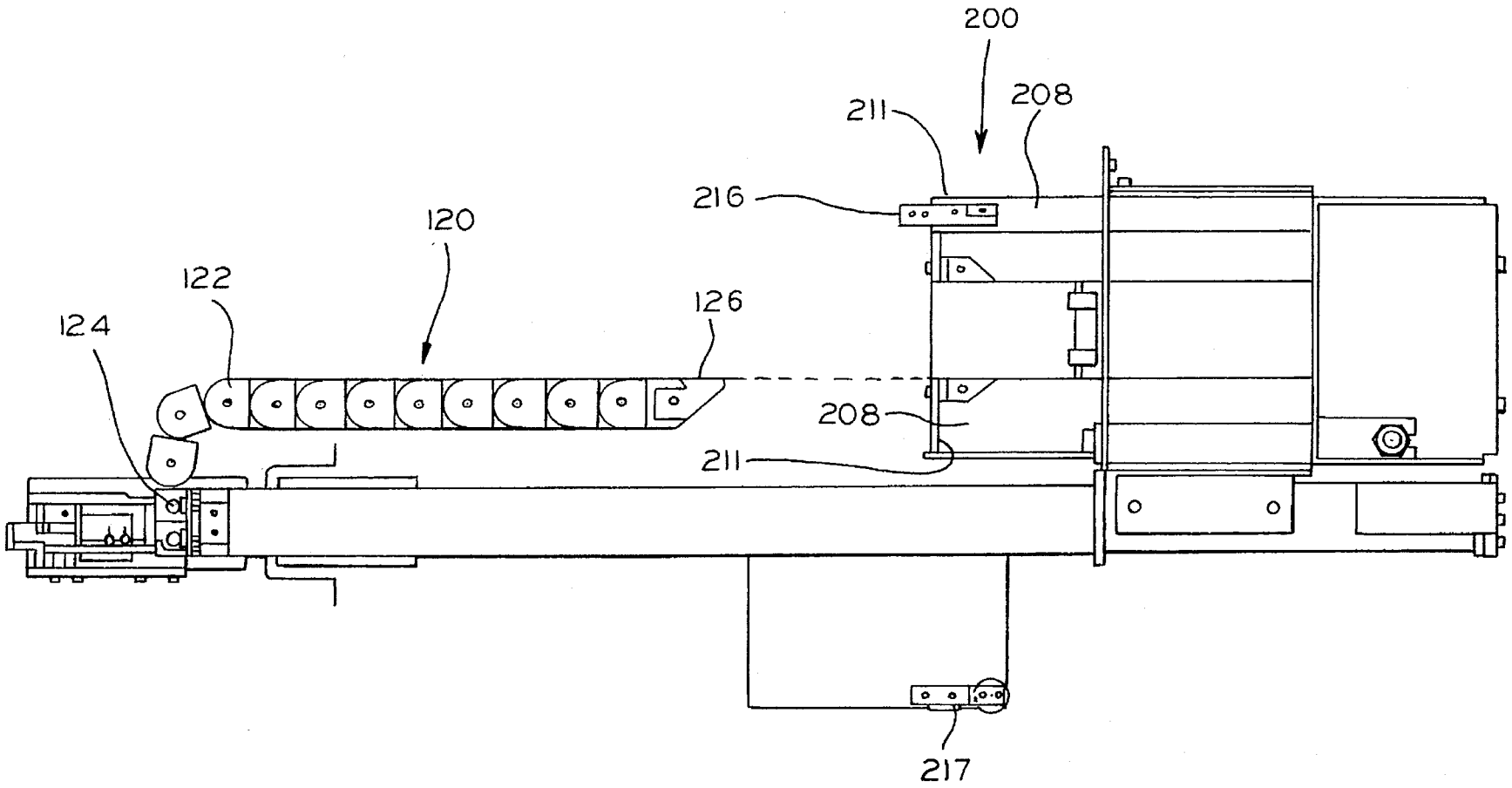
FIG. 5 is a partial top view of the Sepa of FIG. 2.

FIGS. 2 and 3 also illustrate side and end views, respectively, of the ejector assembly 200 which is disposed within a housing mounted adjacent the lower portion of the magazine 100. The ejector assembly 200 includes an ejector bar 202 for ejecting the lowermost pad from the magazine. In one embodiment, a pair of ejector bars 202 are mounted on a medial portion of an ejector plate 204 having lateral edges slidably disposed in grooves of laterally arranged ejector guides 206 coupled to the housing. The ejector bars 202 are aligned between the lateral flanges and the intermediate flange of the magazine so that a top portion of the ejector bars 202 extends above the level of the support surfaces 102 so as to engage the lowermost pad positioned on the support surfaces 102. The ejector bars 202 and plate 204 are translatable back and forth along the ejector guides 206 from a load position at one end of the ejector assembly, under the magazine and to an eject position at an opposite end of the ejector assembly 200. The ejector bars 202 are movable between the flanges of the magazine so as to allow passage below the magazine. In the load position, the ejector bars are positioned to the left and are clear of the magazine as shown in FIG. 2. When the ejector bars 200 move from the load position toward the eject position, a forward end portion 207 of the ejector bars 200 engage an end surface of a lowermost pad as the ejector bars 200 move between the support surfaces 102 of the magazine. A series of roll pins 210 may be disposed along the forward end portion 207 of the ejector bars 200 to facilitate engaging the pad. The ejector bars 200 then slide the lowermost pad, from beneath the stack, along the support surfaces 102 and out of the magazine through a discharge opening in the magazine. The discharge opening includes a space 106, sufficiently large to permit passage of a single pad, between side portions 108 of the magazine and the support surfaces 102 of the lateral flanges. The side portions 108 retain the stacked pads, directly above the ejected lowermost pad within the magazine. FIG. 5 shows the lowermost pad supported by lateral support members 208 of the ejector assembly as the pad is ejected from the magazine. Each lateral support member 208 is aligned with a corresponding support surface 102 of the magazine so as to provide a substantially continuous support surface along which the ejected pad is moved from the stack. In another embodiment, a spring actuated keeper 212 applies a downward force on a top surface of the ejected pad so as to bias the ejected pad toward and in contact with the lateral support surfaces 208 of the ejector assembly. One or more guide plates 211 disposed along outer portions of the lateral support surfaces 208 guide the ejected pad along an appropriate path to ensure that the ejected pad is properly aligned on the lateral support member 208 for subsequent transfer to the gripper assembly 300 as discussed below. A sensor 216 may be mounted on the frame above an end portion of the ejector assembly to detect the presence of an ejected pad. The ejected pad extends over an end portion of the ejector assembly and is positioned within the range of the sensor 216 which detects the presence of the pad. After the lowermost pad is ejected, the ejector plate 204 and ejector bars 202 may return to the load position, clear of the magazine, which permits the next pad to drop down and contact the support surfaces 102 of the magazine in position for ejection, wherein the ejection cycle is repeated. In an alternative embodiment, the magazine includes only the lateral flanges for supporting the pad stack, and the ejector assembly includes a single ejector bar. The ejector bars are translated back and forth by a pneumatically actuated band cylinder 218 mounted in the housing of the ejector assembly. For example, a Tolomatic™ Model No. BC100-100PN band cylinder with a seven inch stroke may be employed. The exemplary embodiment of FIG. 3 shows the ejector plate 204 coupled to the band cylinder 218 by an ejector adaptor 220 assembly including a U-shaped member. Pneumatic power is supplied to the band cylinder by gas hoses, not shown in the drawing, to actuate a piston back and forth in the cylinder as is known in the art.

Figure 4:
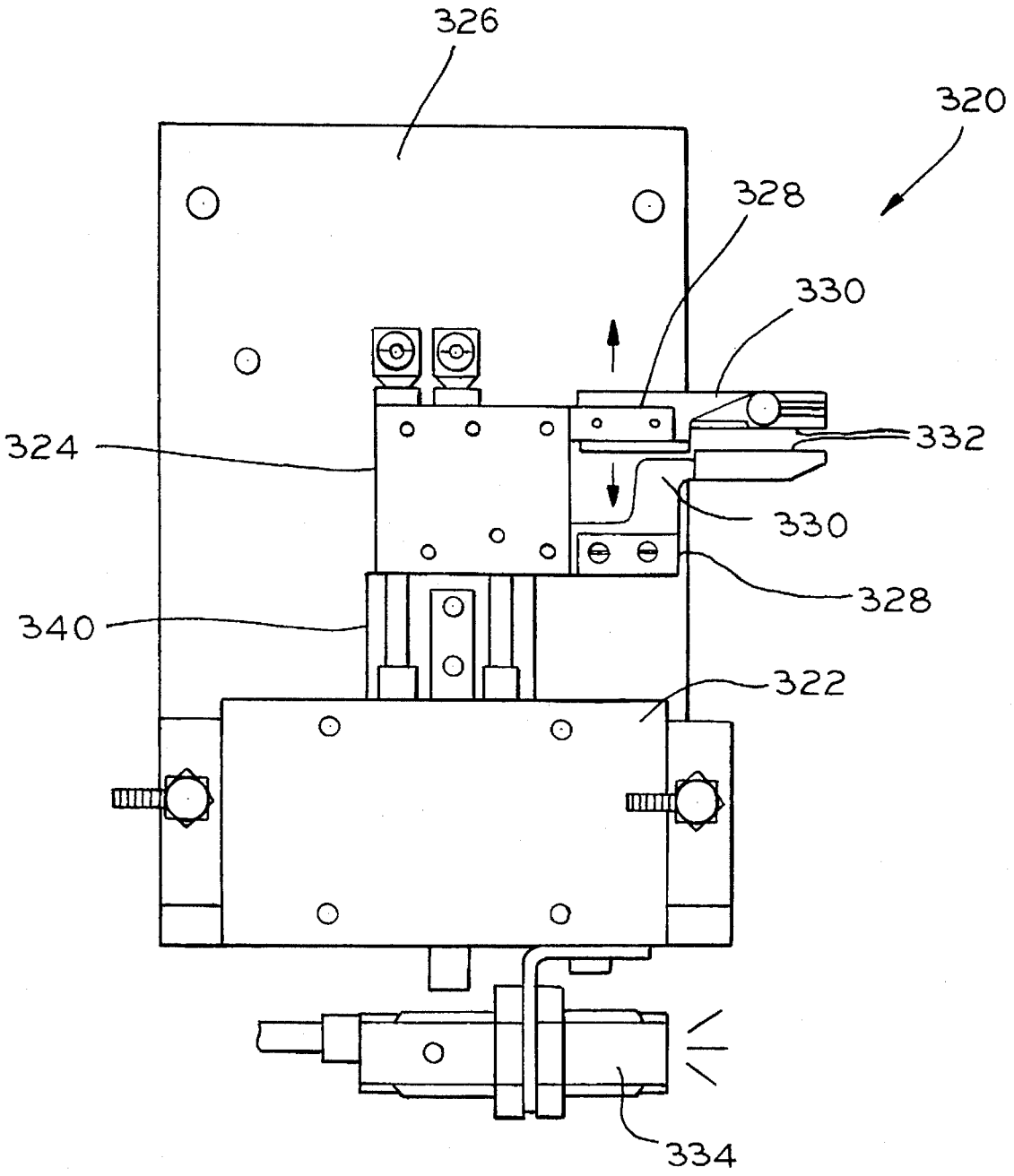
FIG. 4 is a detailed partial side view of a pad gripper assembly of the Sepa of FIG. 2.

FIGS. 2, 3 and 4 illustrate side and end top views of the gripper assembly 300 mounted adjacent the ejector assembly 200. The gripper assembly 200 includes a pad gripper assembly 320 for transferring an ejected pad from the ejector assembly 200 to the load as discussed below. The pad gripper assembly 320 is slidably coupled to a track 302 for positioning the transferred pad adjacent to an edge of the load, and is translatable back and forth along the track 302 between a pad transfer position and a pad insertion position. The track 302 may for example be a pneumatically operated band cylinder by Tolomatic™, Model No. BC100-125PN with a thirty six inch stroke. Other types of translation means having different dimensions may also be suitable for use in the present invention. In the exemplary embodiment, the second band cylinder or track 302 is coupled at one end to the magazine 100 by a cylinder mounting tube and plate assembly 304. The second band cylinder 302 may also be supported by the frame at other points along its length, not shown in the drawing, for secure mounting. The pad gripper assembly 320 is coupled to the second band cylinder 302 by a U-shaped bracket 310 and a carrier weldment 308. The shape and size of the carrier weldment is necessarily determined by the mounting location of the second band cylinder 302 so as to properly position the pad gripper assembly 320 in relation to the ejector assembly for transfer of the ejected pad. In an alternative embodiment, a ballast may be required to ensure balanced weight distribution of the pad gripper assembly 320 relative to the band cylinder 302. In another embodiment, the second band cylinder 302 is mounted to structure other than the magazine, and may be configured in an orientation other than that shown in the drawing. In the embodiment for inserting a pad on a top surface edge portion of the load, the Sepa is mounted on a movable platen P, and the U-shaped mounting bracket 310 and weldment 308 are located on a top side of the band cylinder 302 rather than below the band cylinder 302 as shown in the exemplary embodiment. Pneumatic power is supplied to the second band cylinder 302 by gas hoses, not shown in the drawing, to actuate a piston back and forth in the cylinder as is known in the art.

FIG. 4 is a partial side view of the pad gripper assembly 320 which generally includes a rotator actuator assembly 322, as seen in FIG. 3, for rotating a rotatable gripper 324 when the gripper assembly 300 is in the pad transfer position to permit transfer of an ejected pad from the ejector assembly 200 to the gripper assembly 300. The rotator actuator assembly 322 is coupled to the weldment 308 and, in the embodiment shown, is mounted on a plate 326 which is bolted to the weldment 308. The rotatable gripper 324 includes a pair of gripper arms 328 at least one of which is actuatable toward and away from the other as indicated by the arrows. Preferably, both gripper arms are actuatable toward and away from each other. Gripper jaws 330 with opposing teeth 332 are 328 coupled to a respective gripper arm for gripping a pad ejected by the ejector assembly 200. In one embodiment, at least one of the gripper jaws has a toothed portion which is pivotable in relation to the gripper jaw to ensure that the gripping jaws properly engage and retain the pad. The pad gripper assembly 320 also includes a sensor 334 for measuring the proximity of the pad gripper assembly 320 to a side surface of the load. In one embodiment, the sensor is a photoelectric diffuse reflective sensor which detects the presence of the load, or target, within a specified range relative to the pad gripper assembly 320 as the gripper assembly 302 moves toward the load. The detection signal may be used to control translation of the gripper assembly 320 along the second band cylinder 302 as discussed below. For example, the sensor may be a Cutler-Hammer Comet 100 Series Perfect Prox™ type proximity sensor. In one embodiment, the rotator actuator assembly 322 is coupled to the rotatable gripper 324 by an adaptor block 340 which also rotates with the gripper 324.

In the exemplary embodiment, the rotator actuator assembly 322 and the rotatable gripper 324 are pneumatically actuated, wherein pneumatic power is supplied to the rotator actuator assembly 322 and the rotatable gripper 324 by gas hoses, not shown in the drawing, as is known in the art. The Sepa includes a flexible cable and hose carrier 120 as seen in FIG. 5 for providing pneumatic gas hoses and electrical cables to the gripper assembly 300 as it translates back and forth along the second band cylinder 302. In one embodiment, the carrier is comprised of a series of hinged links 122 through which the hoses and cable are routed in a bundle and securely retained. The flexible carrier 120 is mounted to the weldment 308 at a first end 124 and to the frame at a second end 126, wherein an intermediate portion of the flexible carrier 120 is supported by the frame, for example a shelf or ledge portion, as the gripper assembly 300 translates along the second band cylinder 302. An air valve stack and pneumatic assembly 112 as seen in FIG. 2, may be mounted on the magazine or other portion of the frame for distributing pneumatic pressure from a pneumatic source to the band cylinders, the rotator actuator, gripper assembly, and other pneumatic assemblies. A junction box 106 housing an electrical panel may also be mounted on the magazine or frame, which includes a push-button operator 108 for powering the Sepa, and one or more indicator lamps 110 for indicating that the Sepa is powered, pad supply, and system faults. The indicators however may be located at a convenient location separate from the junction box. The components of the Sepa assembly are supported by frame structure shown by phantom lines, which may be a stand alone frame or integrated components of the strapping station.

Figure 8:
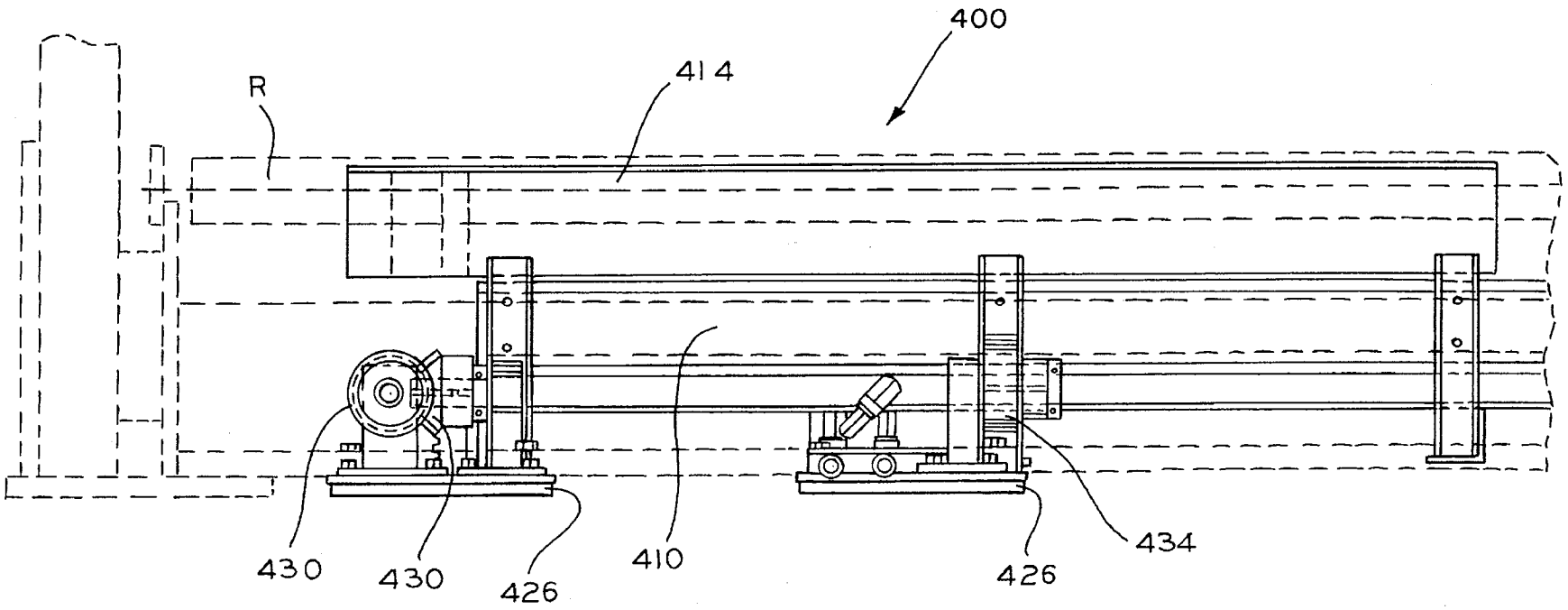
FIG. 8 is a partial end view of the load lift assembly of FIG. 7.

FIG. 6 is a partial top view of a load lift assembly 400 which is disposed below the deck D of the strapping system for raising the load above the deck D to permit the lower Sepa assemblies to insert the pads adjacent lower edges of the load. As discussed above, the deck is comprised of spaced rollers or other spaced deck support members on which the load is positioned in the strapping system prior to application of the strapping. FIG. 7 is a partial sectional end view of the load lift assembly 400 disposed below the deck of the strapping station, and FIG. 8 is a partial end view of the load lift assembly 400 of FIG. 7. The lift assembly 200 includes a movable lift frame 410 having a series of spaced support members 414 spaced to correspond with the spacing between the rollers R or spaced deck support members of the strapping station. The lift frame 410 is raised and lowered so that the spaced support members 414 may be raised between the rollers R to lift the load above the deck. In one embodiment, the load is raised approximately one and three quarter inches above the deck, but the height may be more or less as required to position the pad adjacent a bottom edge portion of the load. The lift frame 410 is raised and lowered by one or more pneumatic lifters 418, sometimes referred to as pancake cylinders, geometrically positioned below the frame. In one embodiment, the frame 410 has a generally rectangular shaped perimeter comprising outer support members 412 interconnected by intermediate cross braces 416 under which four pneumatic lifters are positioned and on which the lifters act to raise and lower the frame 410. The lifter assembly includes a rack and pinion guide assembly 400 that acts on all four sides of the frame to guide the frame 410 as it is raised and lowered. The guide assembly includes an arrangement of shafts 420 aligned along each side of the frame 410. The shafts are rotatable in bearing supports 424 mounted to a plate 426 or otherwise secured in relation to the strapping station 10. The ends of the shafts 420 include a miter gear 430 which is engaged with a miter gear 400 of the other shafts at intersecting comers. The shafts 420 also include pinion gears 434 fixed to intermediate portions of the shaft. The pinion gears 434 engage toothed racks 436 fixed along corresponding portions of the frame 410. As the frame 410 is raised and lowered, it simultaneously rotates the pinion gears 434 and the shafts 420 which are interconnected by the miter gears 430, and coupled by rack and pinion to the respective side portions 412 of the frame, to ensure that all sides of the frame 410 are raised and lowered in unison. In one embodiment, the lifter assembly 400 includes proximity sensors 440 arranged to determine whether the frame is raised or lowered.

In an integrated mode of operation, a load is positioned onto and raised above the deck by the lifter assembly 400. The following sequence of operations generally occurs simultaneously in each Sepa. The gripper assembly 320 is initially located proximate the ejector assembly 200 in the pad transfer position, and the opened gripper jaws are directed along the axis of the second band cylinder 302. After a pad has been properly ejected from the ejector assembly 200, which is detectable by the sensor 216, the rotator actuator assembly 322 rotates the rotatable gripper 324 approximately 90 degrees toward the ejected pad so that the jaws 330 of the gripper 324 extend over and under a portion of the ejected pad. The rotatable gripper 324 is then actuated so that the gripper jaws 330 engage and retain the ejected pad. The gripper 324 is then rotated 90 degrees by the rotator actuator 322 assembly back to its initial position wherein the gripper jaws 330 are directed along the axis of the second band cylinder 302. The transferred and rotated pad may be detected by a second sensor 217 as seen in FIG.

5, to verify that the pad is properly positioned for movement toward the load. Improper ejection or transfer of the pad will be detected by the proximity sensors 216 or 217 which may actuate an audio or visual indicator and or interrupt operation of the machinery. The gripper assembly 320 and pad are then translated along the second band cylinder 302 toward the load. The lower Sepa position the pads adjacent a bottom surface edge portion of the load between the load and the deck, and the upper Sepas position the pads adjacent a top surface edge portion of the load between the load and the platen. As discussed above, the proximity sensor 334 generates a proximity signal for indicating when the gripper assembly 320 is properly positioned along the second band cylinder 302 within a specified range from the side surface of the load. The specified range permits the gripper jaws 330 to position the pad adjacent an edge portion of the load so that a portion, approximately one-half, of the pad extends over the edge of the load. After all of the lower pads have been properly positioned as indicated by the gripper assembly proximity sensors, the load lift assembly 400 lowers the load down onto the deck, wherein the pads are partially positioned between the load and the deck. After the proximity sensors of the lift assembly 400 detect that the load has been lowered, the grippers 324 release the lower pads. Likewise, after all of the upper pads have been properly positioned as indicated by the upper gripper assembly proximity sensors, the platen lowers onto the load, wherein the pads are positioned between the load and the platen. Depending on the load type, the platen may compress the load prior to application of the strapping. The upper grippers however may release the upper pads after sufficient pressure is applied to the load to retain the pads between the load and the gripper. The positioning of the load onto the deck and the lowering of the platen occurs substantially at the same time, as does the release of the upper and lower pads, although it is not critical that the operations be performed simultaneously. After the upper and lower pads have been released and the load is properly compressed, the strapping applicators apply the strapping about the load. The gripper assemblies 320 may be returned to the transfer position prior to or after application of the strapping. After the strapping is applied, the load is removed from the deck and the process is repeated. In one embodiment, a computer or microcontroller controls operation of the system. In alternative embodiments, the Sepa may be arranged apart from the strapping station for ejecting articles other than pads and positioning the articles proximate a target in operations unrelated to protecting edges of a load, and the load lift assembly may likewise be used for lifting loads in operations unrelated to packaging.

The foregoing is a description enabling one of ordinary skill in the art to make and use the preferred embodiments of the present invention. It will be appreciated by those skilled in the art that there exists variations, modifications and equivalents to the embodiments disclosed herein. The present invention therefore is to be limited only by the scope of the appended claims.

What is claimed is:

1. A strapping system in which edge protectors are disposed between a load and tensioned strapping applied around said load at a strapping station, comprising:

deck means for defining a strapping station at which a load is supported so as to have tensioned strapping applied to said load;

lower edge protector applicator assemblies, located upon opposite sides of said load disposed at said strapping station, for positioning lower edge protectors adjacent to opposite bottom surface edge portions of said load;

means for raising said load above said deck so as to permit said lower edge protectors to be inserted, by said lower edge protector applicator assemblies, between said bottom surface edge portions of said load and said deck, and for lowering said raised load back down onto said deck so as to secure said lower edge protectors between said bottom surface edge portions of said load and said deck;

upper edge protector applicator assemblies, located upon opposite sides of said load disposed at said strapping station and above said lower edge protector applicator assemblies, for positioning upper edge protectors adjacent to opposite top surface edge portions of said load;

means, movable with respect to said top surface of said load between a first position at which said movable means is spaced from said top surface of said load, for permitting said upper edge protectors to be inserted, by said upper edge protector applicator assemblies, between said top surface edge portions of said load and said movable means, and a second position at which said movable means is disposed adjacent to said top surface of said load for securing said upper edge protectors between said movable means and said top surface edge portions of said load; and strapping means for applying tensioned strapping around said load whereby said upper and lower edge protectors respectively secured between said movable means and said top surface edge portions of said load, and between said bottom surface edge portions of said load and said deck, are respectively folded over said top and bottom surface edge portions of said load upon the application of said tensioned strapping around said load so as to protect said top and bottom surface edge portions of said load from said tensioned strapping.

2. The strapping system of claim 1, wherein:

said movable means comprises a platen; and said upper edge protector applicator assemblies are mounted upon said movable platen.

3. The strapping system as set forth in claim 1, further comprising:

an edge protector magazine for housing a plurality of edge protectors.

4. The strapping system of claim 3, wherein each one of said edge protector applicator assemblies further comprises:

an ejector assembly for ejecting an edge protector, to be mounted upon said load, from said edge protector magazine;

a gripper assembly for gripping an edge protector ejected by said ejector assembly and for transporting said edge protector toward said load;

a first proximity sensor coupled to said gripper assembly for detecting the proximity of said gripper assembly with respect to said load so as to ensure proper positioning of said edge protector adjacent to said load; and a second proximity sensor disposed adjacent to said ejector assembly for detecting whether said edge protector has been properly ejected from said edge protector magazine.

5. The strapping system of claim 4, wherein:

said gripper assembly comprises movable jaws for gripping said ejected edge protector.

6. The strapping system of claim 5, wherein said gripper assembly comprises:

a rotatable gripper comprising said gripper jaws at least one of which is actuatable; and a rotator actuator assembly operatively connected to said rotatable gripper for rotatably moving said rotatable gripper.

7. The strapping system of claim 6, wherein:

said edge protector magazine comprises a support surface upon which a lowermost edge protector is supported; and said ejector assembly comprises an ejector bar, movable back and forth along an ejector guide, for engaging said lowermost edge protector disposed upon said support surface of said magazine so as to eject said lowermost edge protector from said magazine and position said ejected edge protector for transfer to said gripper assembly.

8. The strapping system of claim 6, wherein said gripper assembly further comprises:

a third proximity sensor for detecting whether said gripped edge protector has been properly rotatably oriented by said rotatable gripper for movement toward and application upon said load.

9. The strapping system of claim 1, wherein:

said deck has spaces defined therein;

said means for raising and lowering said load comprises a frame with spaced support members disposed beneath said deck and aligned with said spaces defined within said deck; and means for raising and lowering said frame and for guiding said frame as said frame is raised and lowered such that said support members of said frame extend through said spaces defined within said deck so as to lift said load above said deck when said frame is raised with respect to said deck so as to allow positioning of said lower edge protectors adjacent to said load.

10. The strapping system of claim 9, wherein said means for guiding said frame comprises:

a plurality of rotatable shafts respectively aligned substantially parallel to a corresponding side portion of said frame;

each one of said shafts has a miter gear disposed upon its end portions for engagement with a miter gear of an adjacent shaft end so as to permit synchronized rotation of said shafts, and a pinion gear rotatable with said shaft and engageable with a rack disposed upon an adjacent side portion of said frame.

11. The system of claim 10, wherein:

said means for raising and lowering said load further comprises means for detecting raising and lowering said frame; and said means for raising and lowering said frame comprises a pneumatic cylinder.

12. A method of protecting edges of a load from tensioned strapping applied to said load by a strapping applicator at a strapping station, comprising the steps of:

providing a deck for defining a strapping station;

moving a load onto said deck so as to be disposed at said strapping station;

raising said load above said deck of said strapping station;

positioning lower edge protectors adjacent to bottom surface edge portions of said load such that said lower edge protectors are interposed between said bottom surface edge portions of said load and said deck in such a manner that said lower edge protectors extend partially beyond said bottom surface edge portions of said load;

lowering said load back down onto said deck so as to secure said lower edge protectors between said bottom surface edge portions of said load and said deck;

providing a vertically movable means within the vicinity of top surface edge portions of said load;

raising said vertically movable means to a first position at which said vertically movable means is spaced above said top surface edge portions of said load;

positioning upper edge protectors adjacent to said top surface edge portions of said load such that said upper edge protectors are interposed between said top surface edge portions of said load and said vertically movable means in such a manner that said top surface edge protectors extend partially over said top surface edge portions of said load;

lowering said vertically movable means to a second position at which said vertically movable means is disposed adjacent to said top surface edge portions of said load so as to secure said upper edge protectors between said top surface edge portions of said load and said vertically movable means; and applying tensioned strapping around said load and said upper and lower edge protectors, respectively secured between said vertically movable means and said top surface edge portions of said load, and between said bottom surface edge portions of said load and said deck, such that said tensioned strapping respectively folds said extended portions of said upper and lower edge protectors over said top and bottom surface edge portions of said load so as to protect said top and bottom surface edge portions of said load from said tensioned strapping.

13. The method of claim 12, further comprising the step of:

providing said vertically movable means in the form of a platen which is movable toward and away from said top surface of said load between said first and second positions.

14. The method of claim 13, further comprising the step of:

detecting the fact that said upper and lower edge protectors have been properly positioned before lowering said load onto said deck and moving said platen into contact with said load.

15. The method of claim 13, further comprising the steps of:

ejecting each edge protector from an edge protector magazine and positioning said ejected edge protector for transfer to a gripper assembly;

transferring said ejected edge protector to said gripper assembly and moving said transferred edge protector toward said load; and detecting the proximity of said gripper assembly with respect to said load so as to ensure proper positioning of said edge protector adjacent to said load.

16. The method of claim 15, further comprising the steps of:

detecting whether said edge protector has been properly ejected from said magazine before transfer of said edge protector to said gripper assembly; and detecting whether said edge protector has been properly transferred to said gripper assembly before positioning of said edge protector adjacent to said load.

* * * * *